United States Patent [19]

Coffey

[11] Patent Number: 4,880,159

[45] Date of Patent: Nov. 14, 1989

[54] GLUE HEAD FLUSHING SYSTEM

[75] Inventor: James B. Coffey, Dayton, Ohio

[73] Assignee: NCR Corporation, Dayton, Ohio

[21] Appl. No.: 105,420

[22] Filed: Oct. 7, 1987

[51] Int. Cl.[4] ..... B05B 17/04; B05B 15/02

[52] U.S. Cl. ..... 239/1; 118/302; 134/104.2; 134/111; 134/166 C; 239/112; 239/124

[58] Field of Search ..... 239/1, 112, 113, 124, 239/127, 304, 305; 134/102, 104.2, 111, 166 C; 118/302

[56] References Cited

U.S. PATENT DOCUMENTS

| | | | |
|---|---|---|---|
| 3,068,876 | 12/1962 | Taylor | 134/111 |
| 3,179,341 | 4/1965 | Plos et al. | 239/112 |
| 3,348,774 | 10/1967 | Wiggins | 239/124 |
| 3,462,081 | 8/1969 | Gelin et al. | 239/112 |
| 3,720,373 | 3/1973 | Levey | 239/127 |
| 3,816,025 | 6/1974 | O'Neill | 239/127 |
| 3,893,625 | 7/1975 | Wiggins | 239/127 |
| 4,170,489 | 10/1979 | Magnus et al. . | |
| 4,333,773 | 6/1982 | Fjallstrom . | |
| 4,390,126 | 6/1983 | Buchholz et al. | 239/124 |
| 4,487,367 | 12/1984 | Perry et al. | 239/112 |
| 4,509,684 | 4/1985 | Schowiak | 239/112 |
| 4,529,127 | 7/1985 | Huszagh | 239/112 |
| 4,791,946 | 12/1988 | Cavanaugh et al. | 134/166 C |

OTHER PUBLICATIONS

Industriell Teknik, Argang 102, No. 7-8, 1974, p. 37, "Patentprofylax".

*Primary Examiner*—Andres Kashnikow
*Assistant Examiner*—Michael J. Forman
*Attorney, Agent, or Firm*—Wilbert Hawk, Jr.; Albert L. Sessler, Jr.; George J. Muckenthaler

[57] ABSTRACT

A glue head/line flushing system uses compressed air to circulate a cleaning agent or solvent from a reservoir and through filtering elements to a solvent manifold. The glue head/line is connected to the solvent manifold and the glue and/or glue particles are flushed from the glue head/line. The glue head/line is then connected to an air manifold to remove any remaining particles of glue and also any solvent from the glue head/line.

11 Claims, 4 Drawing Sheets

GLUE HEAD FLUSHING SYSTEM

BACKGROUND OF THE INVENTION

The present invention relates to a system for flushing various devices and connecting lines that are used in the production of business forms.

In the business forms industry, it is a well-known fact that presses and collators are used in the manufacture of such business forms and that the various devices associated with the presses and collators include means for gluing the paper or like record media in the manufacture of such business forms.

The means for gluing the paper include gluing heads and lines connecting such heads with other devices such as valves, pumps, filters, drains, couplings, and associated items that comprise a gluing system.

As is generally known in the current state of the art, the gluing heads and associated devices along with the connecting lines ordinarily remain connected in the system whether the gluing system is being used continuously or not. It is also known that most gluing systems are of the "dead-end" type which eventually become clogged if they are not used in a generally continuous manner. Since the various devices remain connected in the present or current state of the art arrangements, it is seen that either the entire system must be flushed at one time or that certain devices and/or lines must be replaced if these items become completely clogged. Of course, it may be possible to clean individual devices, such as glue heads and/or connecting lines if these individual devices can be reasonably and easily disconnected from the system and if it is feasible to clean the items. It is also seen that while the entire system is being flushed, the manufacturing equipment is down and production of the business forms is halted until the glue system has received proper maintenance.

It is the intention of the present invention to provide a flushing system that solves the problems just mentioned.

SUMMARY OF THE INVENTION

The present invention relates to a system for effectively flushing and cleaning gluing equipment used in the manufacture of business forms. More specifically, the invention provides a convenient means to flush and to clean glue heads and glue lines that are difficult to handle, that are filled or coated with glue and therefore dirty or messy, and that require much time to disconnect and clean. Of course, it is seen that in case the heads and/or lines become clogged with dried and hard adhesive, the items may need to be replaced with new parts.

The present system utilizes quick-disconnect couplings with internal shut-off valves in new and/or existing line gluing arrangements to provide a convenient means and method of flushing and cleaning glue heads and lines. The present system permits disconnection of certain glue heads and lines that are not being used for long periods of time, flushing and cleaning of such glue heads and lines, and then permits storing the cleaned heads and lines until such time as they are to be returned to use.

The system includes a reservoir with hot and cold water supplies, and a drainage system, it being noted that water is the preferred solvent-type cleaning agent for the flushing system. The drain of the reservoir is connected by piping to a pumping and filtering system that terminates at a plurality of solvent manifolds. Each solvent manifold is provided with a series of quick-disconnect couplings with shut-off valves to provide a pressurized system. A needle valve is connected to the end of the series connected solvent manifolds and provides means to control the volume and system pressure at the quick-disconnect couplings. A manually operated control valve is used for controlling the operation of the pump utilized in the system. The system is also provided with an air manifold and a series of quick coupling shut-off valves, and a control valve is provided for controlling the air supply to the air manifold.

In view of the above discussion, a principal object of the present invention is to provide a flushing system for gluing devices.

Another object of the present invention is to provide a flushing system that enables removal and cleaning of certain portions of a gluing system without interruption of a production line.

An additional object of the present invention is to provide a flushing system with quick-disconnect couplings to enable cleaning and maintaining of certain portions of a gluing system.

A further object of the present invention is to provide a plurality of series connected manifolds containing cleaning fluid and an air manifold connected for flushing and cleaning gluing parts.

Additional advantages and features of the present invention will become apparent and fully understood from a reading of the following description taken together with the annexed drawing.

DESCRIPTION OF THE PREFERRED EMBODIMENT

Figure 1:
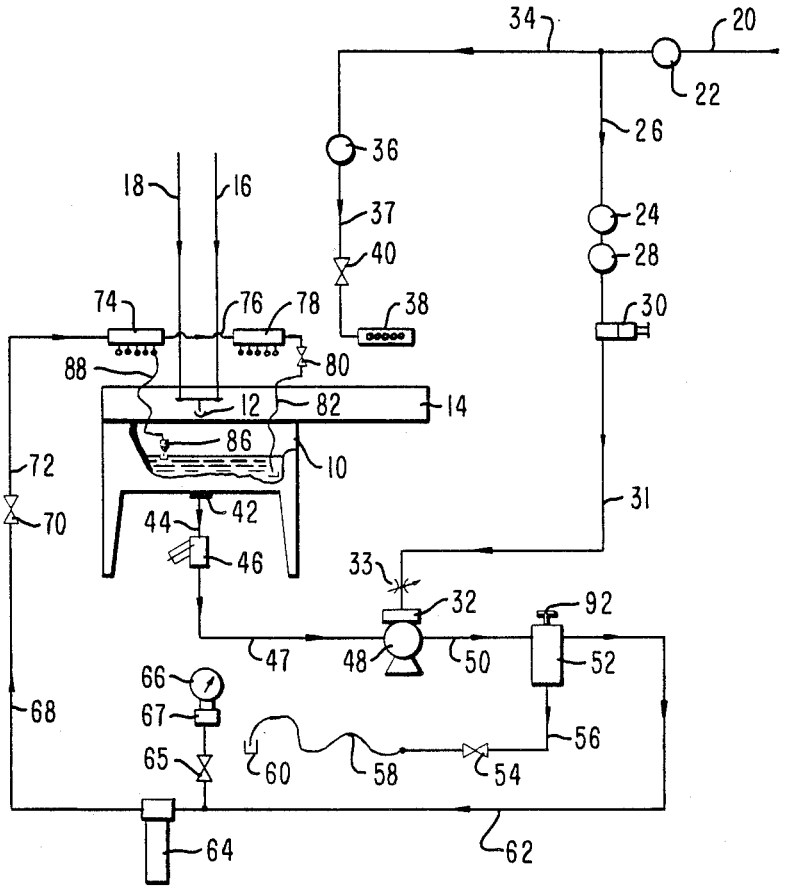
FIG. 1 is a fluid flow diagram of the various devices and connecting lines of the fluid cleaning system.

Referring now to the drawing, FIG. 1 is a fluid flow diagram of the flushing system that includes a commercially available stainless steel sink 10 equipped with a faucet 12 and a drain board 14. The faucet 12 is connected to a cold water supply line 16 and to a hot water supply line 18. The sink 10 is used as a reservoir to provide a convenient means for holding or containing the cleaning agent which may be any of the solvent types and which preferably is water. While water is considered the universal solvent, other cleaning agents may be used in the flushing system, dependent upon supply, feasibility, and condition of the glue that requires flushing from the system.

A line 20 provides a supply of air at 100 psi maximum through a filter 22 that insures the entrapment of foreign particles of certain sizes before they can be introduced into the compressed air circuit of the system. The filter 22 is also used to prevent foreign particles larger than 25 microns from being introduced into the glue heads and glue lines which are purged of solvent after the flushing operation has been performed. A compressed air regulator 24 is connected in a line 26 to establish the operating pressure of 60 psi of the fluid pumping system. A compressed air oil lubricator 28 also is connected in the line 26 to provide oil lubricating to an air pump control valve 30 and a line 31 connects the control valve 30 to an automatic cycling valve 32. The automatic cycling valve 32 is associated with and is a part of an air diaphragm pump 48. A needle valve 33 is provided in the line 31 to control the volume of air to the pump 48.

A line 34 is connected to the downstream side of the air filter 22 and a compressed air regulator 36 is connected in the line 34 to control the air pressure at 20 psi available at an air manifold 38. A line 37 connects the regulator 36 and a globe valve 40. The globe valve 40 is connected in the line 37 to control the volume of air available at the manifold 38.

The stainless steel sink 10 has a removable, flat top strainer 42 that is used to prevent large particles of debris from entering the drain pipe 44 located below the sink. A Y-type strainer 46 is provided in the drain pipe 44 to trap foreign particles that may be of a size to pass through the strainer 42 and that may be large enough to cause the air pump 48 to malfunction or to become damaged. A line 47 connects the Y-type strainer 46 and the air pump 48. The control valve 30 is used to start and stop the air pump 48. A line 50 connects the air pump 48 and an in-line filter 52 that is used to trap foreign particles greater than 200 microns that may pass through the air pump. A two-way ball valve 54 is connected in a line 56 from the filter 52 to provide ways and means for controlling the flushing system. A flexible hose 58 is connected to the downstream side of the ball valve 54 for the purpose of bypassing a portion of the recirculating system and the hose empties into a drain 60.

A line 62 is connected to the in-line filter 52 and to an in-line cartridge filter 64 that is used to trap foreign particles greater than 50 microns that may pass through the filter 52. A pressure gauge 66 is connected in the line 62 from the in-line filter 52 to the cartridge filter 64. A ball valve 65 and a gauge guard 67 are provided for the pressure gauge 66. The filter 64 is connected to a two-way ball valve 70 by a line 68 and the ball valve is connected by a line 72 to a solvent manifold 74. A line 76 connects the manifold 74 to a second solvent manifold 78. The solvent manifolds 74 and 78 are positioned above the reservoir portion of the sink 10. A needle valve 80 is connected to the solvent manifold 78 to control the volume and pressure available for flushing at the two manifolds 74 and 78. A flexible hose 82 is connected to the needle valve 80 for the purpose of bypassing a portion of the recirculating system and the hose empties into the sink 10. A glue head 86 and a glue line 88 are shown connected to the solvent manifold 74 in a typical flushing operation using the structure of the present invention.

Figure 2:
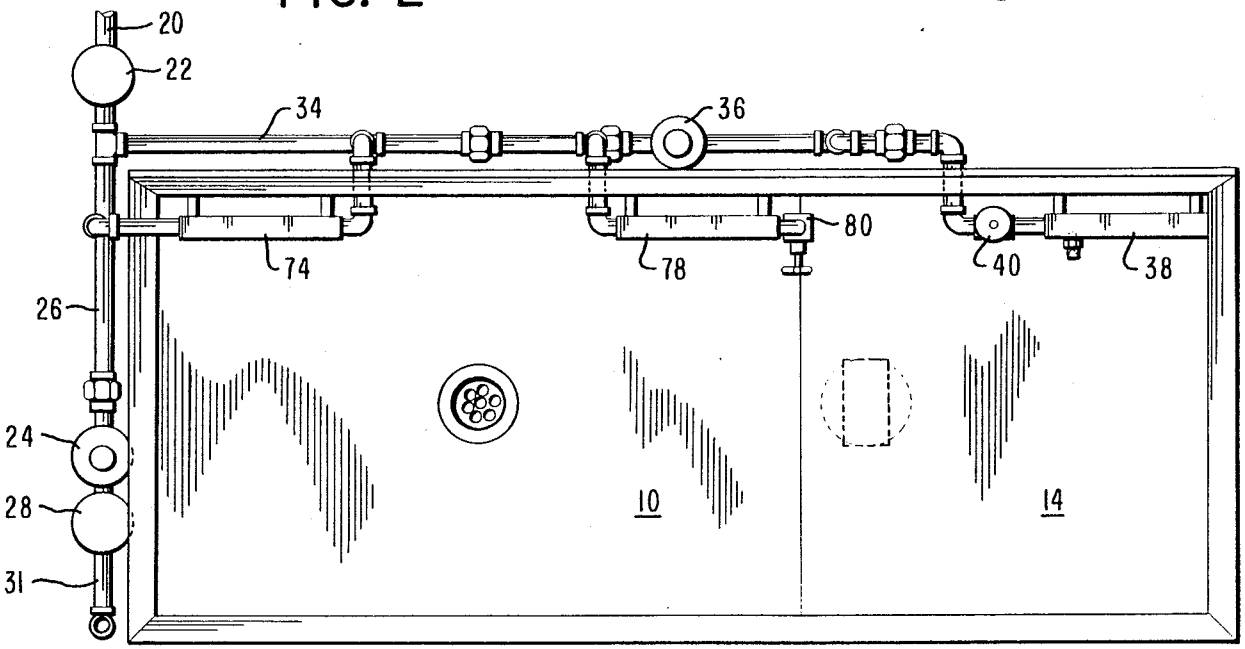
FIG. 2 is a top plan view of the reservoir and certain lines associated therewith.
Figure 3:
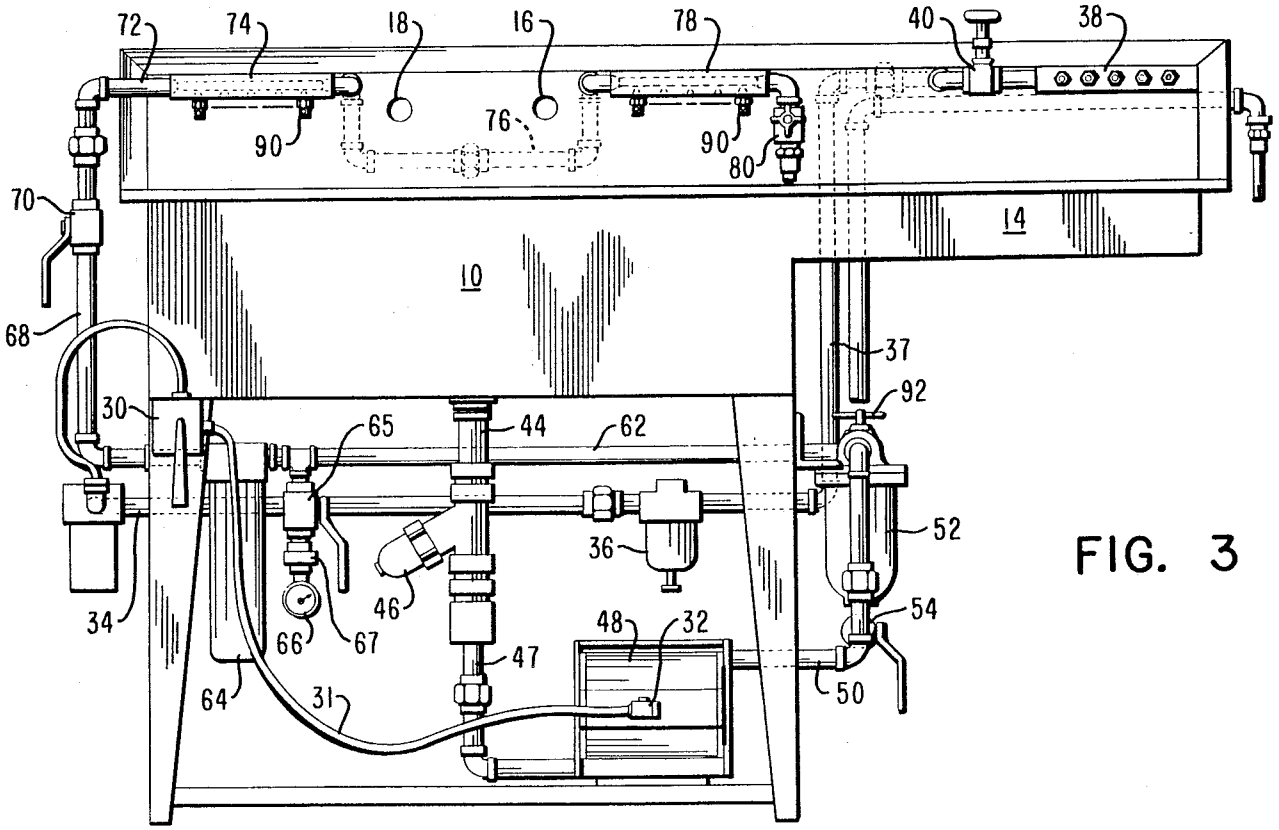
FIG. 3 is a front elevational view of the reservoir showing devices and lines connected thereto.
Figure 4:
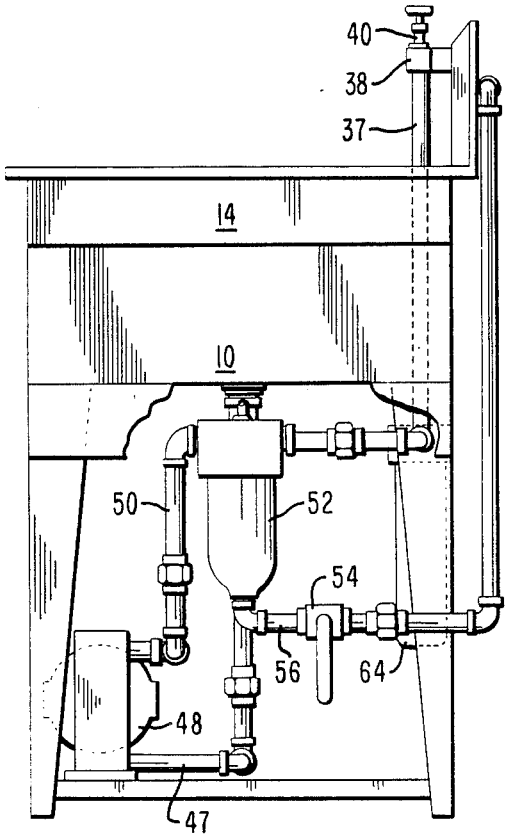
FIG. 4 is a side elevational view of the reservoir showing devices and lines connected thereto.

FIGS. 2, 3 and 4 are a top plan view, a front elevational view, and a side elevational view, respectively, of the reservoir or sink 10 and the associated devices of the flushing system. The sink faucet 12 (FIG. 1) is connected to the cold water supply line 16 and to the hot water supply line 18 (FIG. 3) and has a six inch swing nozzle (not shown). The filter 22 (FIG. 2) in the air supply line 20 is provided to trap any foreign particles entering the compressed air circuit of the system. The air regulator 24 and the oil lubricator 28 along with the control valve 30 (FIG. 3) are provided in the air line 26 and the flow of air is through the line 31 to the needle valve 33 (FIG. 1) and through the cycling valve 32 to the air pump 48. The air regulator 36 and the globe valve 40 (FIG. 3) are connected in the air line 34 to the air manifold 38.

The Y-type strainer 46 is connected in the drain line 44 from the sink 10 to the air pump 48 (FIG. 3), and the in-line filter 52 and the ball valve 54 are provided in a line 56 downstream of the air pump 48 (FIGS. 2 and 3).

The cartridge filter 64 is connected in the line 62 and the gauge 66 is inserted between the in-line filter 52 and the cartridge filter 64 in the line 62 (FIG. 3). The line 68 connects the filter 64 and the ball valve 70. The line 72 connects the ball valve 70 and the solvent manifold 74.

More specifically, the solvent manifolds 74 and 76 are constructed with quick-connect couplings to permit an individual glue head/line to be flushed and cleaned or to connect a plurality of glue heads/lines which are to be flushed and cleaned simultaneously. The air manifold 38 is similar in construction to the solvent manifolds 74 and 78 in the manner of connecting the glue heads and lines to the manifold 38, and compressed air is used to purge the glue heads and lines of water or other solvent that remains in the heads and lines after the flushing and cleaning operation.

The assembly 90 (FIG. 3) for coupling the glue head/line to either the manifold 74 or 78 includes a coupling body, a coupling insert, an insert seal, a polyethylene tube fitting nut, a body plug, and a dust cover, all available from Colder Products Company, St. Paul, Minnesota. The assembly 90 provides the coupling body with an internal valve portion that permits flow through the valve portion when coupled with the insert seal and seals the assembly when the insert seal is disconnected. The coupling body is used to keep the system pressurized when only one glue head/line is being flushed and cleaned. The coupling body is provided with a latching device to prevent accidental uncoupling under system pressure, and the quick coupling feature is convenient in not requiring additional tools when connecting and disconnecting the items to be flushed. The coupling body is screwed into the body of the manifolds 38, 74 and 78 and remains with the manifold as a part of the flushing system.

The coupling insert portion of the assembly 90 becomes a part of the glue head/line when such items are being flushed and cleaned. A shut-off feature provides means to keep the glue head and line filled with water until such time that the water is purged from the glue head and line when it is connected to the compressed air manifold 38.

The air diaphragm pump 48 is used to recirculate the water or solvent from the sink 10 through piping to the water manifolds 74 and 78 and, if desired, to the rinse hose 82, such pump 48 operating to force water under pressure through the glue heads/lines that are being flushed and cleaned. The water being flushed through the glue heads/lines returns into the reservoir or sink 10. The pump 48 also is used to pump water from the flushing system to a drain or another container, and the pump 48 also may be used to flush and clean the element in the line filter 52.

The two-way ball valves 54 and 70 (FIGS. 1 and 3) operate in an opening and closing arrangement to provide various ways for controlling the flushing system. A description of the different operating conditions, dependent upon the position of the two valves and assuming that the air pump 48 is pressurized and that glue heads/-lines are being flushed, is as follows:

Condition No. 1 —Valve 70 is closed and valve 54 is closed wherein the pump 48 stalls and fluid circulation is stopped.

Condition No. 2—Valve 70 is open and valve 54 is closed wherein the pump 48 operates and water circulates through the system.

Condition No. 3—Valve 70 is open and valve 54 is open wherein water circulates through the system and pumps to the drain at the same time.

Condition No. 4—Valve 70 is closed and valve 54 is open wherein the flow of water to the manifolds 74 and 76 is stopped and recirculation is stopped but allows water to be forced through the filter 52 which effectively flushes and cleans the filter and pumps water through the valve 54 and to the drain 60.

The in-line filter 52 traps foreign particles greater than 200 microns and is designed so the filter can be manually cleaned by rotating the handle 92 (FIGS. 1 and 3) on the top of the filter. The filter also is provided with a bottom pipe connection that permits the filter to be flushed (remove foreign particles) without removing the filter from the system or dismantling the piping from the system. The filter 52 is an important item in the flushing system because it is sized to trap foreign particles that are approximately one-half the size of the smallest glue nozzle being flushed and cleaned. This filter permits the operator to conveniently flush the system at any time in that the filter 52 can be flushed during the flushing and cleaning cycle of a glue head/-line, if required, and while the system is recirculating.

The in-line cartridge filter 64 is used to trap foreign particles greater than 50 microns and to prevent small particles of adhesive that may not be dissolved in water from entering the water flushing manifolds 74 and 78. The filter 64 also is used to insure that the internal shut-off valves, located internally of the coupling body and the coupling insert of the glue head/line coupling assembly 90 of the system, are not held open by any foreign particles that are recirculating during the flushing cycle and that are large enough to cause leaks and/or pressure loss in the system.

The pressure gauge 66 has a dial that registers 0–100 psi and includes glycerine to prevent gauge wear in a pulsating system. The gauge is used to read an increase in pressure at the cartridge filter 64, thereby indicating when it is necessary to change the cartridge in the filter. The guard 67 is also provided for the gauge to prevent the recirculating fluid of the system from entering the pressure gauge mechanism and possibly damaging the gauge. Additionally, the ball valve 65 is used to isolate the gauge 66 when filter inspection is not required.

In the operation of the flushing system, a glue head 86 coupled with tubing or hose 88 to a coupling insert that will connect to a water manifold 74, 78, or to an air manifold 38, is disconnected from the press/collator system. The glue head 86 and associated tubing normally are filled with glue when they are disconnected from the system. The flushing system reservoir or sink 10 is filled with solvent to a depth of approximately six to eight inches. The operator connects one or more glue heads 86 which require flushing to the solvent manifolds 74 or 78.

The air pump 48 is started and solvent is pumped from the reservoir 10 through the piping and filtering system to the solvent manifolds 74 and 78 and through the glue heads 86 connected to the manifolds. The system recirculates the solvent from the reservoir 10 through the various devices and the manifolds 74 and 78 and through the connected glue heads 86 and drain back to the reservoir. The volume and pressure in the system are controlled by using the needle valve 80 (FIG. 1) which operates in bypassing solvent from the manifolds 74 and 78 back to the reservoir 10. The system continuously recirculates the solvent through the glue heads 86 connected to the manifolds 74 and 78 until all adhesive has been purged or flushed and cleaned from the glue heads. The time of the flushing cycle is sufficient so that the adhesive is dissolved by the solvent to prevent clogging of the filtering system.

After the glue head has been purged of adhesive and flushed clean with solvent, the glue head is disconnected from the solvent manifold 74 or 78 and is connected to the air manifold 38. The remaining solvent in the flushed glue head 86 then is purged from the head by means of the compressed air. This operation is continued until the head is completely clean. The flushed and cleaned glue head 86 is reconnected to the press-/collator system or is placed in storage until such head will be used in the system.

The features and advantages of the flushing system are the use of quick-disconnect couplings with internal double shut-off valves and the use of manifolds as a convenient means for connecting glue lines which allow for use of shorter glue supply lines. The off-line pressurized pumping system provides means for simulating the on-line pressurized glue system and the filtering system insures that the glue heads/lines are thoroughly cleaned. An individual glue head/line or multiple glue heads/lines can be flushed and cleaned by use of the manifolds and connections to the hot and cold water supply lines 18 and 16. Any foreign particles that would clog glue heads/lines can be conveniently flushed from the system and down a drain thereby permitting continuous operation of the system. The flushing system can be totally recirculating and/or recirculating and draining simultaneously, and the air purging manifold provides a means to purge the flushed glue heads/lines of all cleaning solvents. The use of the quick disconnect couplings with internal shut-off valves provides a means to keep a line that is disconnected from an on-line glue system to be filled with adhesive. The maintaining of the adhesive or glue in the line prevents the disconnected line from drying out and becoming clogged before it can be flushed and cleaned. The internal shut-off valves also provide an advantage after flushing with solvent and before purging a flushed line with compressed air because the flushed glue head/line will remain filled with solvent or contain a certain amount of solvent between the solvent flushing and the air purging operation. This feature keeps the glue head/line wet and prevents any dried glue particles from adhering to the head or line and thereby provides a time delay for convenience until one or more flushed glue heads/lines can be purged with air. The quick disconnect couplings allow the system to remain pressurized and operational thereby eliminating machine down time when glue heads or lines become clogged. The system pumping pressure can be varied for different solvent pumping pressures that may be required. The system component materials have been selected to be compatible with commonly used, water based, resin type adhesives. Various other commercially available or designed components can be used and sized to be compatible with differing conditions without affecting the basic system concept.

Availability of the pertinent parts and components of the present system are as follows: the sink 10 is an Elkay Scullery sink, SS-8136R, the air filter 22 is Arrow No. F-402-04-F, the air regulator 24 is Arrow No. 1584G, and the air lubricator 28 is Arrow No. 6504BG. The ball valves 54, 65 and 70 are Appollo No. 96-103 and the needle valve 80 is Appollo 60-613-01. The assembly 90 for coupling the glue head/line to the manifold 74 or 78 includes a coupling body No. PMCD 10-02-12-V, a coupling insert No. PMCD 20-04-12-V, an insert seal No. 1003-08V, a tube fitting nut No. 1008-00, a dust cover No. PMC32 and a coupling body plug No. PMC31. The globe valve 40 is Hammond FIG. 600, the air control valve 30 is Hunt Model 42, and the Y-type strainer 46 is McMaster-Carr No. 9793K25. The air pump 48 is Wilden Model M-1-KT-TF-TF-KT and the in-line filter 52 is AMF-CUNO Type GH, No. 10149-03-40-0080. The in-line filter 64 includes AMF-CUNO cartridge type filter housing Model CT-101 and AMF-CUNO filter cartridge No. D-PPPL. The pressure gauge 66 is Ashcroft No. 1009A-021 and the gauge guard 67 is Plastomatic No. GGMVl-PP. The needle valve 33 is ARO flow control No. F02.

It is thus seen that herein shown and described is a flushing system for flushing and cleaning glue heads/-lines of glue or glue particles. The flushing system of the present invention enables the accomplishment of the objects and advantages mentioned above, and while a preferred embodiment has been disclosed herein, variations thereof may occur to those skilled in the art. It is contemplated that all such variations not departing from the spirit and scope of the invention hereof are to be construed in accordance with the following claims.

What is claimed is:

1. A material flushing system for glue head nozzles comprising a reservoir; a supply of solvent connected with said reservoir;

air-operated pumping means having a cycling valve and coupled to said reservoir and adapted to circulate solvent in a path from the reservoir through piping and back to the reservoir; a control valve for starting and stopping said pumping means, a supply of air connected to said control valve and coupled to the cycling valve of said pumping means for controlling automatic operation of the pumping means; a solvent manifold operably associated with the piping and including quick-disconnect coupling means having internal valves for connecting said nozzles to the solvent manifold for circulating solvent through the nozzles and for flushing material from the nozzles while maintaining a pressurized condition in the flushing system; and an air manifold connected to said supply of air and including means for connecting said nozzles to said air manifold for cleaning the nozzles of any material or solvent remaining therein after flushing the glue head nozzles with solvent through the solvent manifold.

2. The flushing system of claim 1 wherein said solvent is water.

3. The flushing system of claim 1 wherein said pumping means is air operated pump connected to said supply of air and to said reservoir.

4. The flushing system of claim 1 wherein the solvent manifold includes a plurality of connectors for receiving the nozzles.

5. The flushing system of claim 1 wherein the air manifold includes a plurality of connectors for receiving the nozzles.

6. The flushing system of claim 1 wherein the material flushed from the nozzles is glue-like adhesive material.

7. The flushing system of claim 1 including an in-line filter coupled to the pumping means and to the solvent manifold for trapping foreign material particles greater than 200 microns.

8. The flushing system of claim 7 including an in-line cartridge filter coupled to the in-line filter and to the solvent manifold for trapping foreign material particles greater than 50 microns.

9. The flushing system of claim 1 wherein the coupling means for connecting the glue head nozzles to the solvent manifold permits through flow of fluid when the glue head nozzles are connected to the solvent manifold and for sealing of the solvent manifold when the nozzles are disconnected therefrom while maintaining said pressurized condition.

10. A method of flushing material from adhesive applying heads in a flushing system comprising the steps of:

providing a reservoir;

connecting a supply of solvent to the reservoir in a pressurized condition;

providing a solvent manifold having a quick-disconnect coupling means with internal valves and connecting said solvent manifold to the supply of solvent, providing an air manifold with a supply of air connected thereto;

connecting the adhesive applying heads to the quick-disconnect coupling means of the solvent manifold for circulating solvent through the heads and for flushing adhesive material from the heads while maintaining said pressurized condition of said flushing system with said internal valves, pumping solvent by means of controlling the pumping automatically with said supply of air in a path from the reservoir through piping and circulating the solvent through said solvent manifold and through the adhesive applying heads back to the reservoir; and connecting the applying heads to the air manifold for cleaning the heads of any material or solvent remaining therein after flushing adhesive material from the heads with solvent through the solvent manifold.

11. The method of claim 10 wherein the step of connecting the adhesive applying heads to the coupling means of the solvent manifold includes permitting through flow of fluid when the adhesive applying heads are connected to the solvent manifold and for sealing of the solvent manifold when the heads are disconnected therefrom in said pressurized condition.

* * * * *